US009200867B1

(12) United States Patent
Swan

(10) Patent No.: US 9,200,867 B1
(45) Date of Patent: Dec. 1, 2015

(54) MODULAR INTEGRATED POWERED HANDGUARD AND ACCESSORY MOUNT SYSTEM FOR COMBAT WEAPONS

(71) Applicant: Richard E. Swan, E. Bridgewater, MA (US)

(72) Inventor: Richard E. Swan, E. Bridgewater, MA (US)

( * ) Notice: Subject to any disclaimer, the term of this patent is extended or adjusted under 35 U.S.C. 154(b) by 0 days.

(21) Appl. No.: 14/592,237

(22) Filed: Jan. 8, 2015

Related U.S. Application Data

(60) Provisional application No. 61/925,003, filed on Jan. 8, 2014.

(51) Int. Cl.
*F41C 23/16* (2006.01)
*F41C 23/22* (2006.01)

(52) U.S. Cl.
CPC ..... *F41C 23/16* (2013.01)

(58) Field of Classification Search
CPC ..... F41C 23/00; F41C 23/16; F41C 23/22; F41G 1/004; F41G 1/003
See application file for complete search history.

(56) References Cited

U.S. PATENT DOCUMENTS

| | | | | |
|---|---|---|---|---|
| 6,490,822 | B1 * | 12/2002 | Swan | 42/71.01 |
| 7,627,975 | B1 * | 12/2009 | Hines | 42/84 |
| 8,091,265 | B1 * | 1/2012 | Teetzel et al. | 42/72 |
| 8,146,282 | B2 | 4/2012 | Cabahug et. al. | |
| 8,322,064 | B2 | 12/2012 | Cabahug et al. | |
| 8,402,683 | B2 * | 3/2013 | Cabahug et al. | 42/85 |
| 8,429,845 | B1 | 4/2013 | Swan | |
| 8,443,539 | B2 * | 5/2013 | Cabahug et al. | 42/85 |
| 8,490,313 | B2 * | 7/2013 | Frascati et al. | 42/90 |
| 8,931,196 | B1 * | 1/2015 | Larue | 42/71.01 |
| 9,062,933 | B1 * | 6/2015 | Allen et al. | 1/1 |
| 2007/0086190 | A1 * | 4/2007 | Kukuk | 362/253 |
| 2010/0031552 | A1 * | 2/2010 | Houde-Walter | 42/72 |
| 2010/0180485 | A1 * | 7/2010 | Cabahug et al. | 42/90 |
| 2010/0192448 | A1 * | 8/2010 | Darian | 42/84 |
| 2010/0229450 | A1 * | 9/2010 | Becker et al. | 42/90 |
| 2010/0319231 | A1 * | 12/2010 | Stone et al. | 42/71.01 |
| 2011/0000120 | A1 * | 1/2011 | Thompson | 42/84 |
| 2011/0010979 | A1 * | 1/2011 | Houde-Walter | 42/84 |
| 2012/0180363 | A1 * | 7/2012 | Frascati et al. | 42/90 |
| 2013/0061504 | A1 * | 3/2013 | Malherbe et al. | 42/84 |
| 2013/0104438 | A1 * | 5/2013 | Hines | 42/84 |
| 2015/0020427 | A1 * | 1/2015 | Compton et al. | 42/71.01 |

* cited by examiner

*Primary Examiner* — Bret Hayes
*Assistant Examiner* — Derrick Morgan
(74) *Attorney, Agent, or Firm* — Barlow, Josephs & Holmes, Ltd.

(57) ABSTRACT

A modular integrated powered hand guard and accessory mount system for a firearm has at least one electrical bus bar for electrically connecting a power source and a powered accessory each secured to the hand guard body. The hand guard body is releasably securable to a firearm, and has at least one dovetail rail. An electrical bus bar received within the hand guard body extends longitudinally between ends of the hand guard body adjacent to the dovetail rail. The electrical bus bar has electrical sockets that are accessible through openings formed in the hand guard body. An accessory mount is configured to engage the dovetail rail, and has a pivotable L-shaped electrical connector for providing an electrical connection from a socket of the electrical bus bar to a powered accessory. A power supply assembly allows a user to connect a battery to a socket on the electrical bus bar.

19 Claims, 7 Drawing Sheets

MODULAR INTEGRATED POWERED HANDGUARD AND ACCESSORY MOUNT SYSTEM FOR COMBAT WEAPONS

CROSS-REFERENCE TO RELATED APPLICATIONS

This application is related to and claims priority from earlier filed U.S. Provisional Patent Application 61/925,003, filed on Jan. 8, 2014, the entire contents of which is incorporated herein by reference.

BACKGROUND OF THE INVENTION

The present invention relates to modular integrated accessory systems for combat weapons and more particularly to a powered handguard assembly and a complementary accessory mount which permits flexible mounting of powered targeting devices onto the powered handguard and electrical power to pass from the powered handguard to the weapon accessory.

Prior art targeting systems including a variety of different devices which require power for their various functions, such as illuminated reticles, laser targeting, night vision, infra-red targeting, and regular white light flashlights. Typically, each device is designed separately and includes its own self-contained power supply. When using a single targeting device, this is not problematic. However, when soldiers deploy multiple targeting systems, each with its own power supply, the combined weight of all of the batteries can become excessive and can created imbalances on the weapon. In addition, the different devices typically do not use the same types of batteries, thus requiring the provisioning of multiple different types of batteries, and more importantly requiring the soldier to carry multiple different types of spare batteries, further adding to the weight.

It has therefore been a desire of the military to simplify combat weaponry by providing a common power source for all accessories mounted onto a weapon and a system for electrically connecting the power source to the various targeting accessories.

Prior art weapon power systems have been known in the art. In general, these systems have attempted to provide power strips on the external surfaces of handguard rails along with contact points on the various accessory devices to make contact with the power strips when mounted. However, these prior art system have met with limited acceptance due to poor reliability in extreme temperature conditions, corrosion, chemical contamination, humidity, exposure to water and dirt, and abrasion.

SUMMARY OF THE INVENTION

The present invention provides a modular integrated powered hand guard and accessory mount system for a firearm. The system allows a user to electrically connect a powered accessory to a power source through the hand guard for a firearm.

A hand guard includes a hand guard body having a forward end and a rearward end, and at least one dovetail rail extending longitudinally between the forward end and the rearward ends. A clamping assembly is configured to releasably clamp the hand guard body to a firearm, so that a user can secure the hand guard body to a firearm that can be separately provided from the hand guard body.

An electrical bus bar provides electrical connection points on the hand guard body. The electrical bus bar is received within a cavity formed in the hand guard body and extending longitudinally between the forward and rearward ends of the hand guard adjacent to the dovetail rail. The electrical bus bar includes a plurality of spaced, outwardly facing electrical sockets which are accessible through a like plurality of spaced openings formed in the hand guard body. When the electrical bus bar is received in a cavity, the sockets align with the openings in the hand guard body.

A user can secure an accessory to the hand guard by way of an accessory mount. The accessory mount has a body having a lower body portion and an upper body portion. The lower body portion configured to engage the dovetail rail of the hand guard. The accessory mount has a clamping assembly configured to releasably clamp the accessory mount to the dovetail rail in a plurality of positions such that the male plug portion of the connector is in alignment for engagement with one of the plurality of sockets in the bus bar.

The accessory mount also allows a user to electrically connect an accessory to the electrical bus bar. The accessory mount has an L-shaped electrical connector pivotably mounted to the accessory mount body. The connector has a female socket portion adjacent the upper body portion and a male plug portion adjacent the lower body portion. The connector is pivotably movable between a disengaged position wherein the male plug portion is not engaged within one of the sockets, and an engaged position wherein the male plug portion is received in mating physical and electrical engagement within one of the sockets, The accessory mount is useful for supporting a powered accessory, which may be separately provided to a user. The powered accessory has a lower surface configured to interface and engage with the upper body portion of the accessory mount and further including an electrical lead and a terminal male plug configured and arranged to be received in mating physical and electrical engagement with the female socket in the connector in the accessory mount.

The system allows the powered accessory to receive power from a power supply assembly. The power supply assembly has a housing that includes a housing portion configured to engage the dovetail rail, a clamping assembly configured to releasably clamp the accessory mount to the dovetail rail in a plurality of positions, a battery power source within the housing, and an electrical lead in electrical communication with the battery power source and having a terminal male plug configured and arranged to be received in mating physical and electrical engagement with one of the plurality of sockets in the electrical bus bar.

The hand guard can include a plurality of dovetail rails extending longitudinally between the forward and rearward ends of the hand guard body. For example, there can be four dovetail rails. A plurality of electrical bus bars are received within a plurality of cavities formed in the hand guard body and extending longitudinally between the forward and rearward ends adjacent to each of the dovetail rails. Each electrical bar has a plurality of spaced, outwardly facing electrical sockets which are accessible through a like plurality of spaced openings formed in the hand guard body. To electrically connect the electrical bus bars in a circuit, a bus bar coupler is included in the system. The bus bar coupler has a plurality of male electrical plugs which are configured and arranged to be received in mating physical and electrical engagement with the sockets in the plurality of electrical bus bars to electrically connect the bus bars together.

The power supply assembly of the system can be provided in the form of a forward hand grip, and can be provided with batteries contained within a grip portion of the forward hand grip.

The present invention allows users to use a common power source for all accessories mounted onto a weapon. The present invention also provides a system for electrically connecting the power source to the various targeting accessories. The present invention provides a system that can endure extreme temperature conditions, corrosion, chemical contamination, humidity, exposure to water and dirt, and abrasion.

BRIEF DESCRIPTION OF THE DRAWING FIGURES

The invention will now be described further by way of example with reference to the following examples and figures, which are intended to be illustrative only and in no way limiting upon the scope of the invention.

DETAILED DESCRIPTION OF AN EXEMPLARY EMBODIMENT

Figure 1:
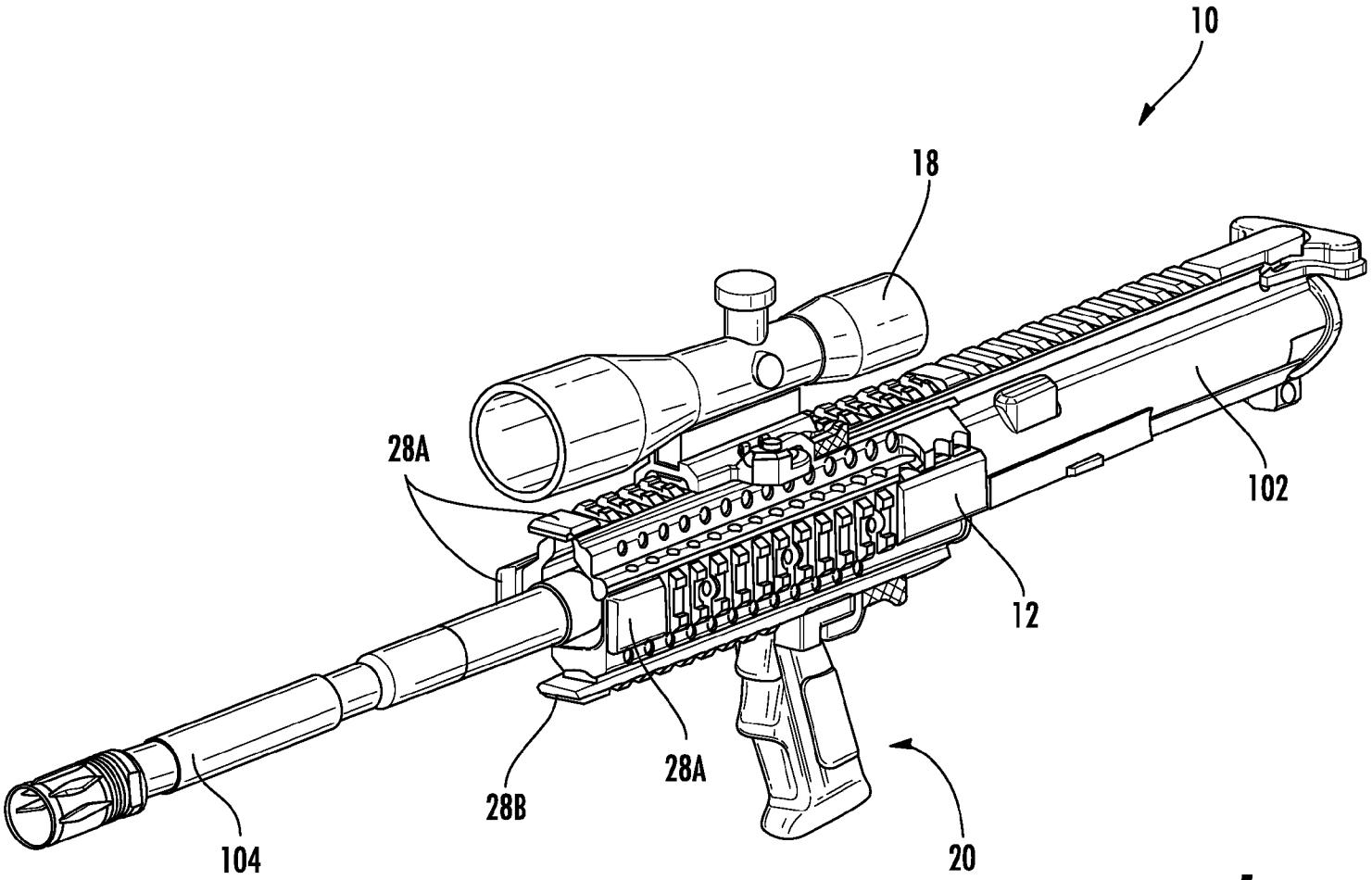
FIG. 1 is a perspective view of the modular integrated powered hand guard and accessory mount system of the present invention.

Referring to FIG. 1, a modular integrated powered hand guard and accessory mount system 10 for a firearm in accordance with the teachings of the present invention generally comprises a hand guard 12, at least one electrical bus bar 14 received within the hand guard 12, an accessory mount 16, a powered accessory 18, and a power supply assembly 20. For clarity, only the upper receiver 102 and barrel 104 of the firearm are shown.

Figure 2:
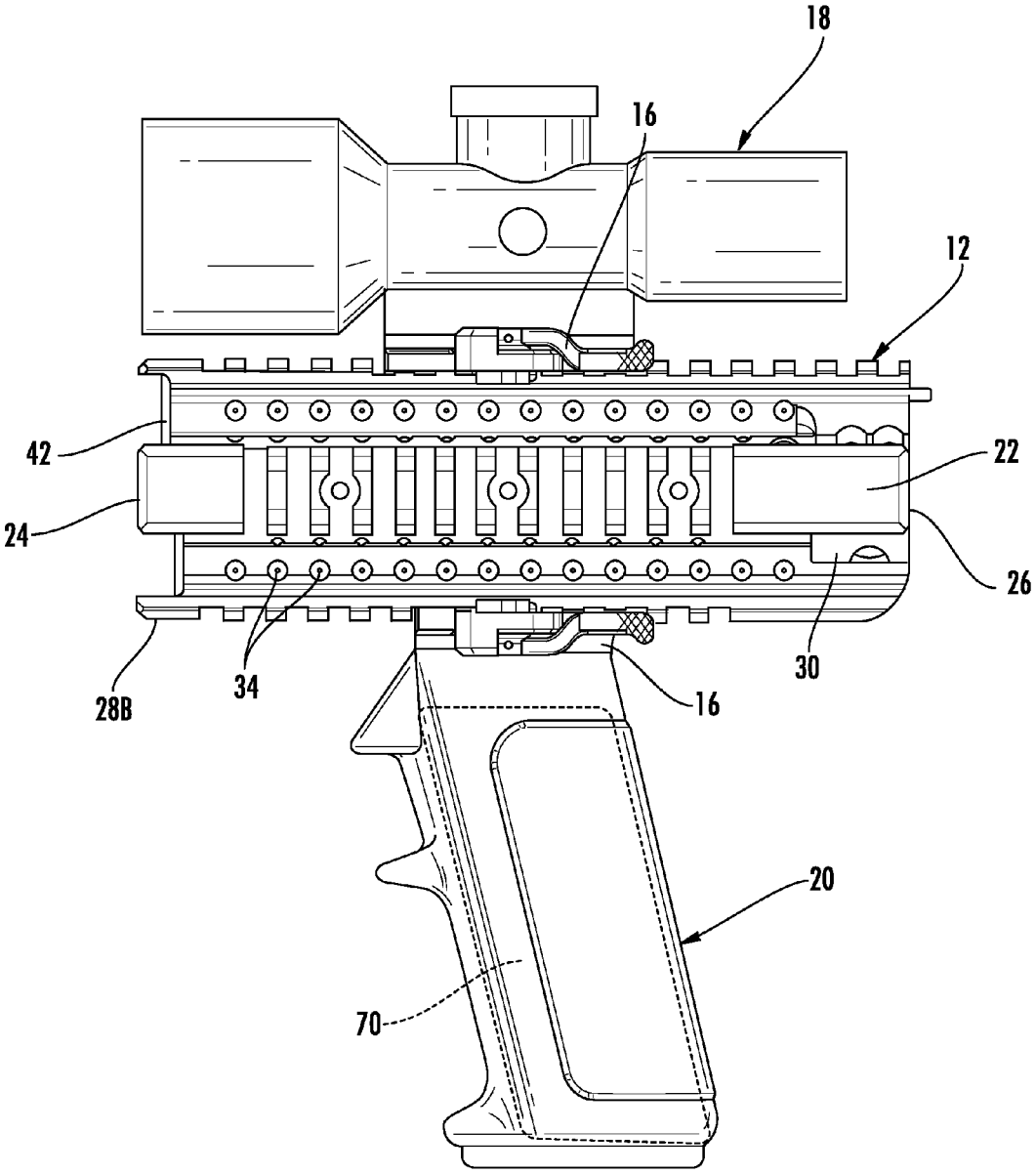
FIG. 2 is a left side view thereof.
Figure 3:
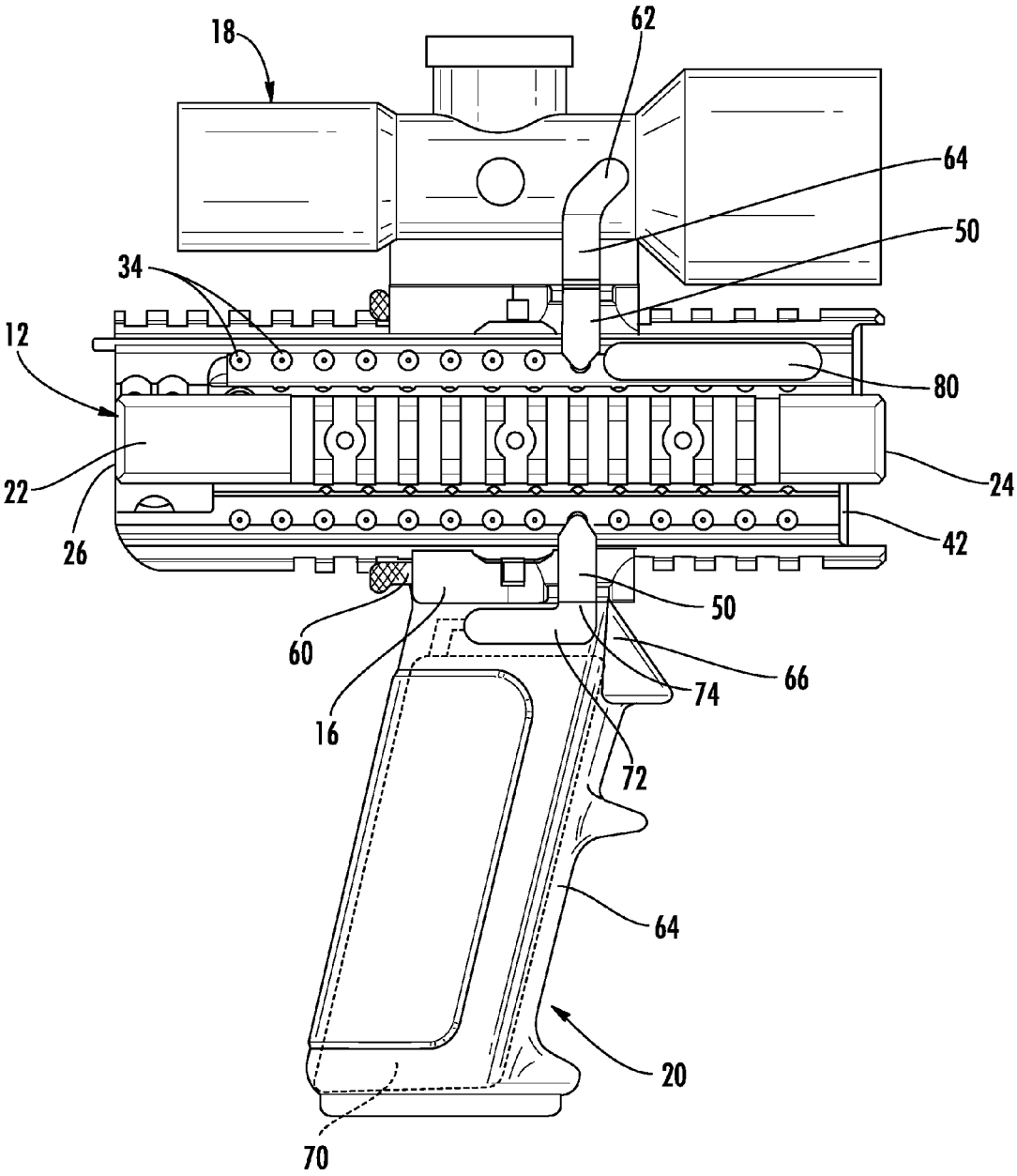
FIG. 3 is a right side view thereof.
Figure 4:
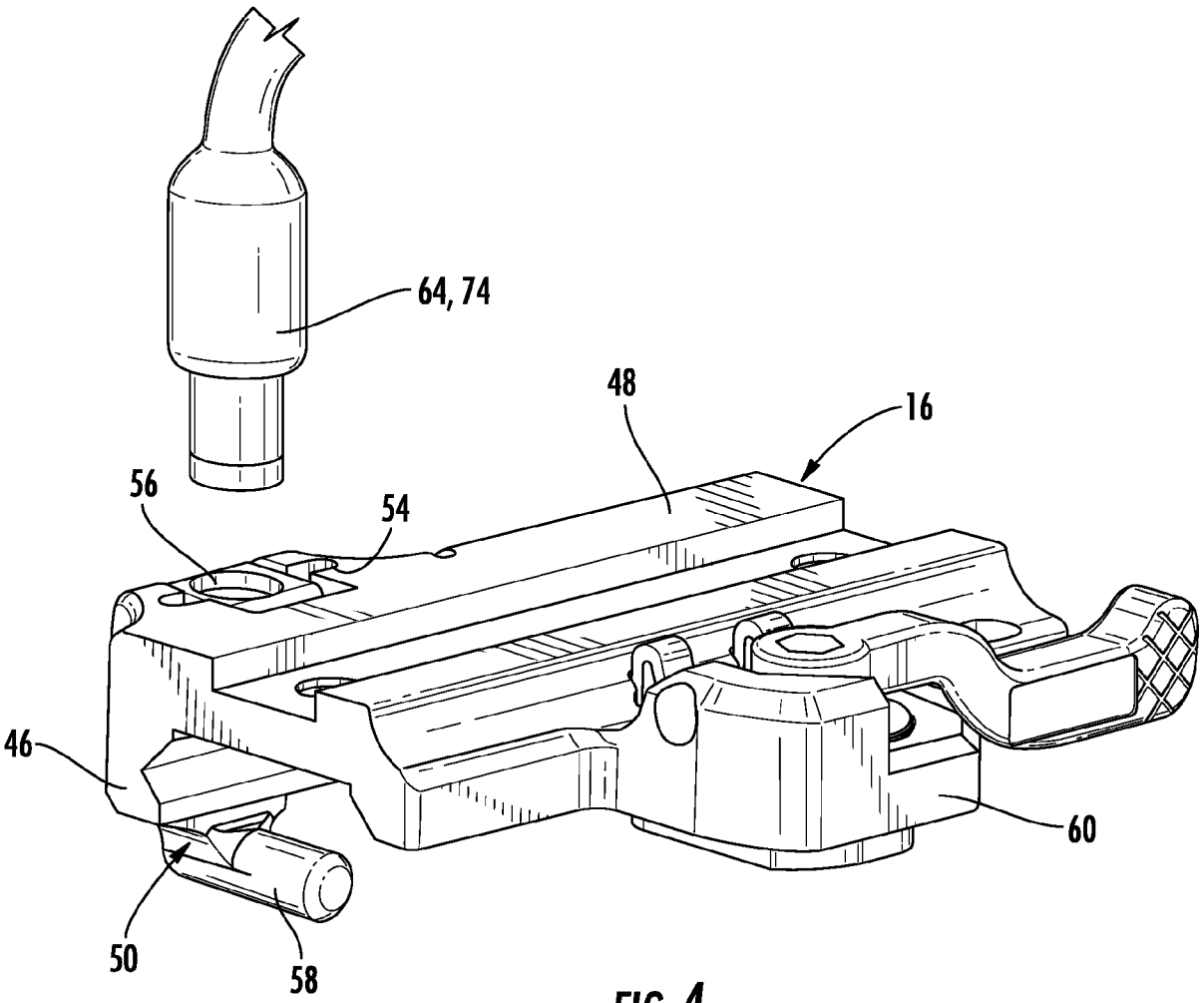
FIG. 4 is a perspective view of the accessory mount and a power connection system.
Figure 5:
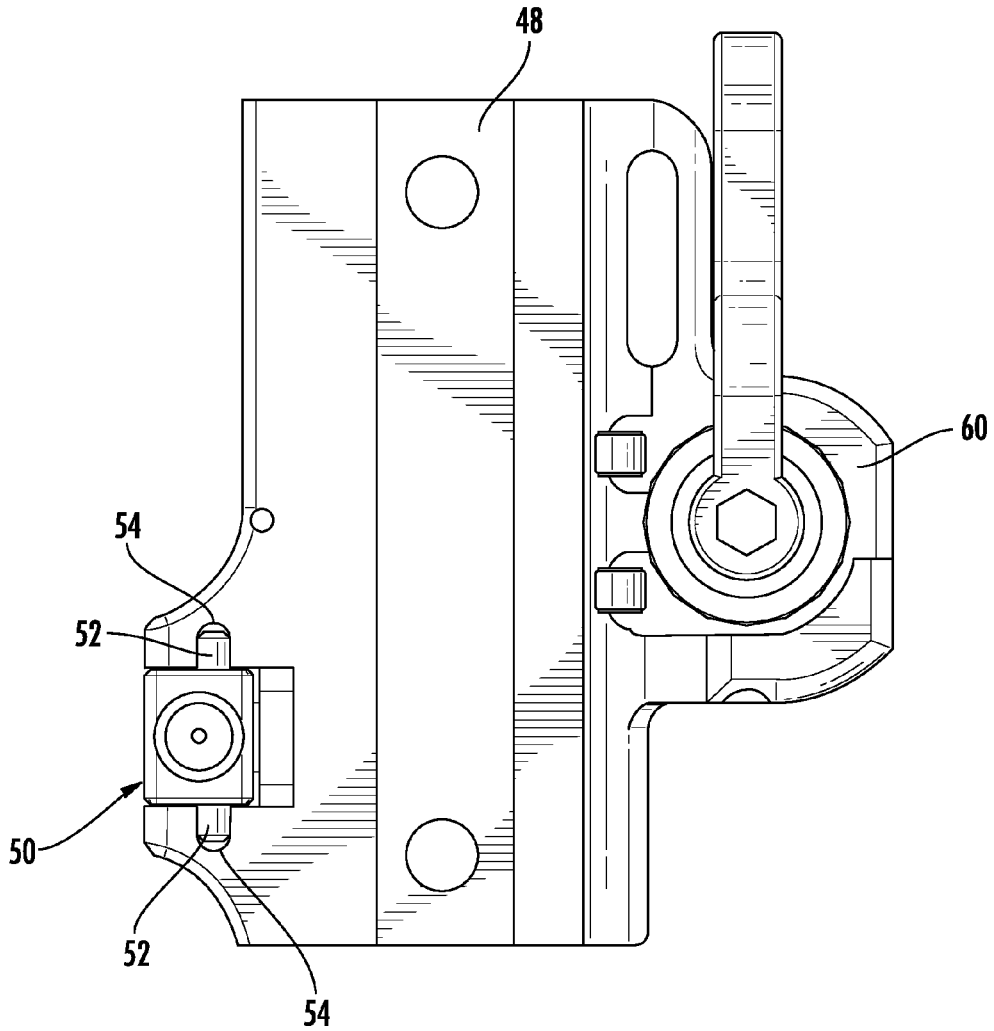
FIG. 5 is a top view thereof.

Referring to FIGS. 1-3, the hand guard 12 comprises a hand guard body 22 having a forward end 24 and a rearward end 26 and further having at least one dovetail rail 28A, 28B extending longitudinally between the forward and rearward ends 24, 26. More specifically, the hand guard 12 includes an upper hand guard portion having three spaced dovetail rails 28A located at the 9 o'clock 12 o'clock and 3 o'clock positions. A lower hand guard portion is removably received with the upper hand guard portion and provides a fourth dovetail rail 28B located at the lower 6 o'clock position. The hand guard 12 further includes a hand guard clamping assembly 30 which is configured to releasably clamp the hand guard 12 to the upper receiver 102 of the firearm. The specific hand guard 12 as illustrated is received over the barrel nut and is secured to the barrel nut with a clamp that extends under the barrel nut.

Figure 7:
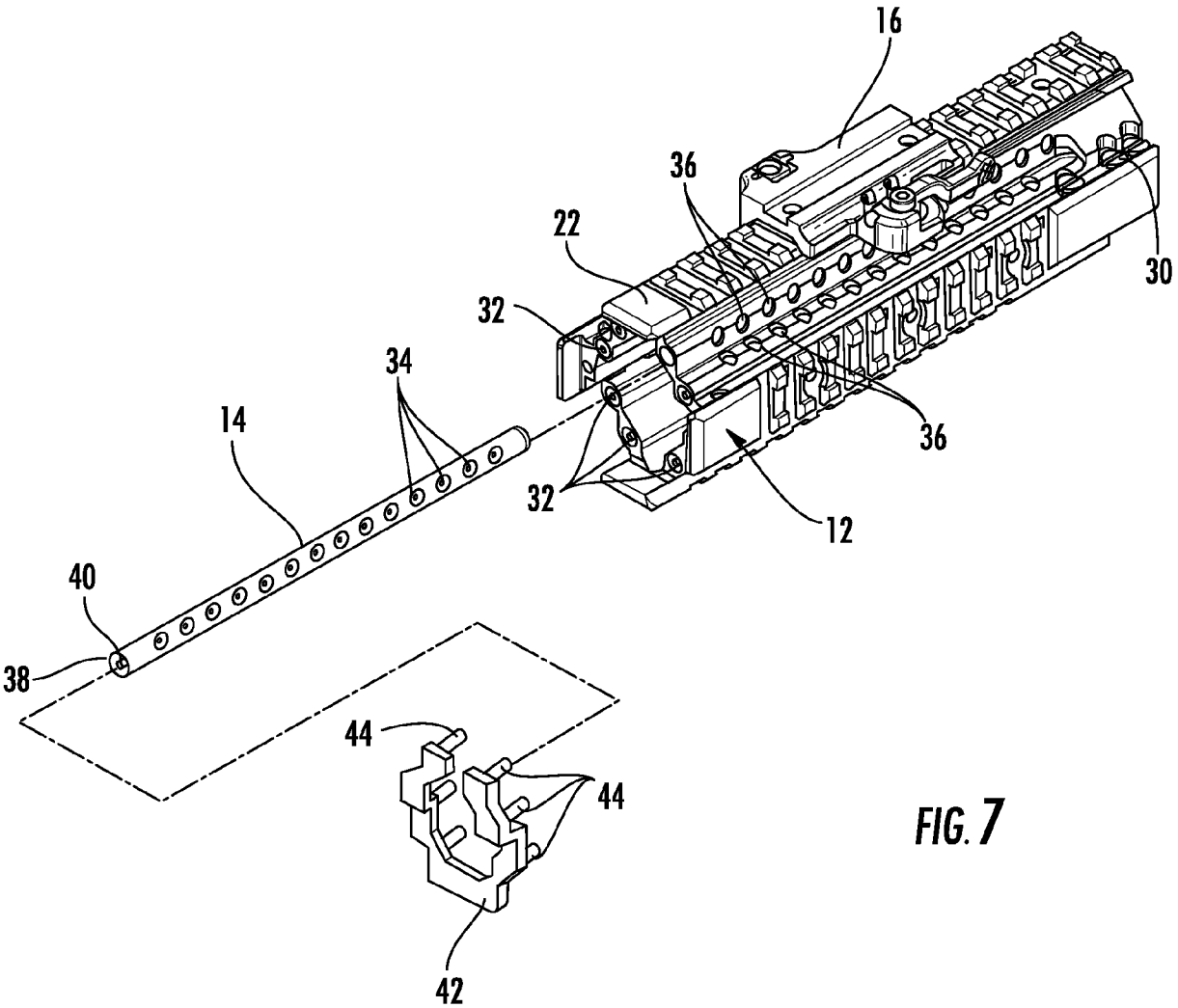
FIG. 7 is an exploded perspective view of the electrical bus bar extending through the hand guard along with the bus bar connector plug.

To provide an electrical circuit within the hand guard 12, a plurality of electrical bus bars 14 are received within longitudinal cavities 32 formed in the hand guard body 22. These bus bars 14 extend longitudinally between the forward and rearward ends 24, 26 of the hand guard 12 immediately adjacent to the dovetail rails 28A, 28B. As seen in FIG. 7, eight bus bars 14 are provided with two opposing bus bars 14 being located on opposing sides of each dovetail rail 28A, 28B.

Still referring to FIG. 7, each electrical bus bar 14 includes a plurality of spaced, outwardly facing electrical sockets 34 which are accessible through a like plurality of spaced openings 36 formed in the hand guard body 22. Additionally, the terminal end 38 of each bus bar 14 also includes a socket 40 for connection with a bus bar coupler 42. The bus bar coupler 42 includes plurality of male electrical plugs 44 which are configured and arranged to be received in mating physical and electrical engagement with terminal end sockets 40 of electrical bus bars 14 to electrically connect the bus bars together. This arrangement allows all of the electrical bus bars 14 to be connected in a single circuit and connected to a single power source. Alternately, two or more couplers could be utilized to create multiple circuits along multiple bus bars which are separately powered and controlled.

Figure 6:
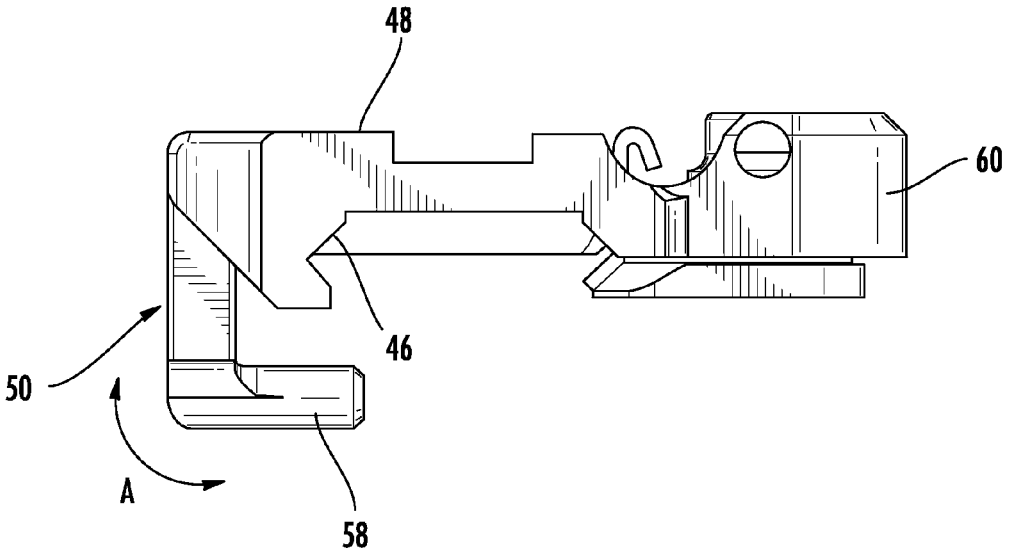
FIG. 6 is a front view thereof.

Referring back to FIGS. 2-6, the accessory mount 16 comprises a body having a lower body portion 46 and an upper body portion 48. The lower body portion 46 is configured to engage the dovetail rail. The accessory mount 16 further comprises an L-shaped electrical connector 50 pivotably mounted on opposing pivot pins 52 to the body. In this regard, the pivot pins 52 are received within corresponding slots 54 on the top of the mount body to provide both pivoting movement along the arrow A in FIG. 6 as well as a small degree of vertical translation. The connector has a female socket portion 56 adjacent the upper body portion 48 and a male plug portion 58 adjacent the lower body portion 46.

The accessory mount 16 further includes a clamping assembly 60 configured to releasably clamp the accessory mount 16 to the dovetail rail 28A, 28B in a plurality of longitudinal positions such that the male plug portion 58 of the connector 50 is in alignment for engagement with one of the plurality of sockets 34 along the bus bar 14.

In operation, the L-shaped connector 50 is pivotably movable between a disengaged position (not shown) wherein male plug portion 58 is rotated outwardly and it is not engaged within one the sockets 34, and an engaged position (see FIGS. 2-6) wherein the male plug portion 58 is rotated inwardly and received in mating physical and electrical engagement within one of the sockets 34.

Turning back to FIGS. 1-3, a powered accessory 18, such as an infra-red (IR) night-vision optic, has a lower surface configured to interface and engage with the upper body portion 48 of the accessory mount 16. Rather than having a conventional internal battery, the powered accessory 18 includes an external electrical lead 62 (FIG. 3) and a terminal male plug 64 configured and arranged to be received in mating physical and electrical engagement with the female socket 56 in the connector 50 in the accessory mount 16. Alternatively, the lead 62 could be made long enough to plug directly into the bus bar 14 in the hand guard 12. However, a significant advantage and purpose of the L-shaped connector 50 in the accessory mount 16 is to provide a rigid, yet low profile connection into the hand guard 12 which will not be easily dislodged during use. The male plug 58 of the L-shaped connector 50 snaps into engagement with a firm friction fit and is not easily dislodged.

The last component of the system is a modular power supply assembly 20 comprising a housing 64 having a portion 66 configured to engage the dovetail rail 28A, 28B, or alternatively, as illustrated, a second accessory mount 16 having a clamping assembly 60 configured to releasably clamp the accessory mount 16 and power housing 64 to the dovetail rail 28A, 28B (shown in FIG. 2 as releasably clamped to dovetail rail 28B). In this regard, the modular battery housing 64 is secured to the hand guard 12 in the same manner as the powered accessory 18. A battery power source 70 is located within the housing (see dotted lines in FIGS. 2 and 3), and an electrical lead 72 is in electrical communication with the battery power source 70. The lead 72 includes a terminal male plug 74 configured and arranged to be received in mating physical and electrical engagement with either one of the plurality of sockets 34 in the electrical bus bar 14, or into the female socket 56 in connector 50 of the accessory mount 16, which is in turn connected to the hand guard bus bar 14. In this way, power from the batteries 70 is routed into the electrical bus bar system and provided to the powered accessory 18.

As illustrated, the power supply assembly 20 is provided as a forward hand grip with the batteries 70 received within the cavity of the hand grip. However, the power supply can be embodied in any one of a variety of different forms, such as a simple battery casing that is attached to the hand guard at any unused location on any one of the dovetail rails.

The system could further include plug in switches which could be located anywhere along the bus bars to provide selective switching of the powered accessory.

In order to provide water proof connections, the male and female plug terminals are preferably designed and configured with waterproof sockets and/or boots which will keep water from penetrating into the interior of the electrical connection.

Further on this point, the system is also provided with rubberized waterproof plug strips 80 (See FIG. 3) to fill and close all unused sockets 34 on the hand guard. These strips 80 can be cut to desired lengths and inserted into any exposed socket 34 after the desired configuration is completed.

What is claimed is:

1. A modular integrated powered hand guard and accessory mount system for a firearm comprising:

a hand guard comprising a hand guard body having a forward end and a rearward end and further having a dovetail rail extending longitudinally between the forward and rearward ends, and a clamping assembly configured to releasably clamp said hand guard body to said firearm;

an electrical bus bar received within a cavity formed in said hand guard body and extending longitudinally between the forward and rearward ends of the hand guard adjacent to said dovetail rail, said electrical bus bar including a plurality of spaced, outwardly facing electrical sockets which are accessible through a like plurality of spaced openings formed in said hand guard body;

an accessory mount comprising a body having a lower body portion and an upper body portion, said lower body portion configured to engage said dovetail rail, said accessory mount further comprising an L-shaped electrical connector pivotably mounted to said body, said connector having a female socket portion adjacent said upper body portion and a male plug portion adjacent said lower body portion, said accessory mount further comprising a clamping assembly configured to releasably clamp said accessory mount to said dovetail rail in a plurality of positions such that said male plug portion of said connector is in alignment for engagement with one of said plurality of sockets in said bus bar, said connector being pivotably movable between a disengaged position wherein said male plug portion is not engaged within one of said sockets, and an engaged position wherein said male plug portion is received in mating physical and electrical engagement within one of said sockets, a powered accessory having a lower surface configured to interface and engage with said upper body portion of said accessory mount and further including an electrical lead and a terminal male plug configured and arranged to be received in mating physical and electrical engagement with said female socket in said connector in said accessory mount; and a power supply assembly comprising a housing having a housing portion configured to engage said dovetail rail, a clamping assembly configured to releasably clamp said power supply assembly to said dovetail rail in a plurality of positions, a battery power source within said housing, and an electrical lead in electrical communication with said battery power source and having a terminal male plug configured and arranged to be received in mating physical and electrical engagement with one of said plurality of sockets in said electrical bus bar.

2. The system of claim 1 wherein said hand guard comprises a plurality of dovetail rails extending longitudinally between said forward and rearward ends thereof, said system further comprising a plurality of electrical bus bars received within a plurality of cavities formed in said hand guard body and extending longitudinally between said forward and rearward ends adjacent to said dovetail rails, said electrical bus bars including a plurality of spaced, outwardly facing electrical sockets which are accessible through a like plurality of spaced openings formed in said hand guard body, said system further comprising a bus bar coupler having a plurality of male electrical plugs which are configured and arranged to be receiving in mating physical and electrical engagement with said sockets in said plurality of electrical bus bars to electrically connect said bus bars together.

3. The system of claim 1 wherein said power supply assembly comprises a forward hand grip having batteries contained within a grip portion thereof.

4. A modular integrated powered hand guard and accessory mount system for a firearm comprising:

a hand guard body having a forward end and a rearward end and further having a dovetail rail extending longitudinally between the forward and rearward ends;

a clamping assembly configured to releasably clamp said hand guard body to said firearm;

an electrical bus bar received within a cavity formed in said hand guard body and extending longitudinally between the forward and rearward ends of the hand guard adjacent to said dovetail rail, said electrical bus bar including a plurality of spaced, outwardly facing electrical sockets which are accessible through a like plurality of spaced openings formed in said hand guard body; and an accessory mount comprising a body having a lower body portion and an upper body portion, said lower body portion configured to engage said dovetail rail, said accessory mount further comprising an L-shaped electrical connector pivotably mounted to said body, said connector having a female socket portion adjacent said upper body portion and a male plug portion adjacent said lower body portion, said accessory mount further comprising a clamping assembly configured to releasably clamp said accessory mount to said dovetail rail in a plurality of positions such that said male plug portion of said connector is in alignment for engagement with one of said plurality of sockets in said bus bar, said connector being pivotably movable between a disengaged position wherein said male plug portion is not engaged within one of said sockets, and an engaged position wherein said male plug portion is received in mating physical and electrical engagement within one of said sockets.

5. The system of claim 4, further comprising:

a powered accessory having a lower surface configured to interface and engage with said upper body portion of said accessory mount and further including an electrical lead and a terminal male plug configured and arranged to be received in mating physical and electrical engagement with said female socket in said connector in said accessory mount.

6. The system of claim 4, further comprising:

a power supply assembly comprising a housing having a housing portion configured to engage said dovetail rail, a clamping assembly configured to releasably clamp said power supply assembly to said dovetail rail in a plurality of positions, a battery power source within said housing, and an electrical lead in electrical communication with said battery power source and having a terminal male plug configured and arranged to be received in mating physical and electrical engagement with one of said plurality of sockets in said electrical bus bar.

7. The system of claim 4, further comprising:

a power supply assembly comprising a housing having a housing portion configured to engage said dovetail rail, a clamping assembly configured to releasably clamp said power supply assembly to said dovetail rail in a plurality of positions, a battery power source within said housing, and an electrical lead in electrical communication with said battery power source and having a terminal male plug configured and arranged to be received in mating physical and electrical engagement with one of said plurality of sockets in said electrical bus bar.

8. The system of claim 4 wherein said hand guard comprises a plurality of dovetail rails extending longitudinally between said forward and rearward ends thereof, said system further comprising a plurality of electrical bus bars received within a plurality of cavities formed in said hand guard body and extending longitudinally between said forward and rearward ends adjacent to said dovetail rails, said electrical bus bars including a plurality of spaced, outwardly facing electrical sockets which are accessible through a like plurality of spaced openings formed in said hand guard body, said system further comprising a bus bar coupler having a plurality of male electrical plugs which are configured and arranged to be receiving in mating physical and electrical engagement with said sockets in said plurality of electrical bus bars to electrically connect said bus bars together.

9. The system of claim 4 wherein said hand guard comprises a plurality of dovetail rails extending longitudinally between said forward and rearward ends thereof, said system further comprising a plurality of electrical bus bars received within a plurality of cavities formed in said hand guard body and extending longitudinally between said forward and rearward ends adjacent to said dovetail rails, said electrical bus bars including a plurality of spaced, outwardly facing electrical sockets which are accessible through a like plurality of spaced openings formed in said hand guard body, said system further comprising a bus bar coupler having a plurality of male electrical plugs which are configured and arranged to be receiving in mating physical and electrical engagement with said sockets in said plurality of electrical bus bars to electrically connect said bus bars together.

10. The system of claim 5 wherein said hand guard comprises a plurality of dovetail rails extending longitudinally between said forward and rearward ends thereof, said system further comprising a plurality of electrical bus bars received within a plurality of cavities formed in said hand guard body and extending longitudinally between said forward and rearward ends adjacent to said dovetail rails, said electrical bus bars including a plurality of spaced, outwardly facing electrical sockets which are accessible through a like plurality of spaced openings formed in said hand guard body, said system further comprising a bus bar coupler having a plurality of male electrical plugs which are configured and arranged to be receiving in mating physical and electrical engagement with said sockets in said plurality of electrical bus bars to electrically connect said bus bars together.

11. The system of claim 6 wherein said hand guard comprises a plurality of dovetail rails extending longitudinally between said forward and rearward ends thereof, said system further comprising a plurality of electrical bus bars received within a plurality of cavities formed in said hand guard body and extending longitudinally between said forward and rearward ends adjacent to said dovetail rails, said electrical bus bars including a plurality of spaced, outwardly facing electrical sockets which are accessible through a like plurality of spaced openings formed in said hand guard body, said system further comprising a bus bar coupler having a plurality of male electrical plugs which are configured and arranged to be receiving in mating physical and electrical engagement with said sockets in said plurality of electrical bus bars to electrically connect said bus bars together.

12. The system of claim 7 wherein said hand guard comprises a plurality of dovetail rails extending longitudinally between said forward and rearward ends thereof, said system further comprising a plurality of electrical bus bars received within a plurality of cavities formed in said hand guard body and extending longitudinally between said forward and rearward ends adjacent to said dovetail rails, said electrical bus bars including a plurality of spaced, outwardly facing electrical sockets which are accessible through a like plurality of spaced openings formed in said hand guard body, said system further comprising a bus bar coupler having a plurality of male electrical plugs which are configured and arranged to be receiving in mating physical and electrical engagement with said sockets in said plurality of electrical bus bars to electrically connect said bus bars together.

13. The system of claim 4 wherein said power supply assembly comprises a forward hand grip having batteries contained within a grip portion thereof.

14. The system of claim 4 wherein said power supply assembly comprises a forward hand grip having batteries contained within a grip portion thereof.

15. The system of claim 5 wherein said power supply assembly comprises a forward hand grip having batteries contained within a grip portion thereof.

16. The system of claim 8 wherein said power supply assembly comprises a forward hand grip having batteries contained within a grip portion thereof.

17. The system of claim 9 wherein said power supply assembly comprises a forward hand grip having batteries contained within a grip portion thereof.

18. The system of claim 10 wherein said power supply assembly comprises a forward hand grip having batteries contained within a grip portion thereof.

19. The system of claim 11 wherein said power supply assembly comprises a forward hand grip having batteries contained within a grip portion thereof.

* * * * *